US008403595B2

(12) United States Patent
Hall et al.

(10) Patent No.: US 8,403,595 B2
(45) Date of Patent: Mar. 26, 2013

(54) PLURALITY OF LIQUID JET NOZZLES AND A BLOWER MECHANISM THAT ARE DIRECTED INTO A MILLING CHAMBER

(76) Inventors: David R. Hall, Provo, UT (US); Thomas Morris, Spanish Fork, UT (US)

( * ) Notice: Subject to any disclaimer, the term of this patent is extended or adjusted under 35 U.S.C. 154(b) by 299 days.

(21) Appl. No.: 12/894,309

(22) Filed: Sep. 30, 2010

(65) Prior Publication Data

US 2011/0018333 A1 Jan. 27, 2011

Related U.S. Application Data

(63) Continuation-in-part of application No. 12/888,876, filed on Sep. 23, 2010, now Pat. No. 7,976,238, which is a continuation-in-part of application No. 12/145,409, filed on Jun. 24, 2008, now Pat. No. 7,854,566, which is a continuation-in-part of (Continued)

(51) Int. Cl.
*E01C 23/12* (2006.01)

(52) U.S. Cl. ..... 404/129; 404/94; 299/39.1; 299/39.2

(58) Field of Classification Search ..... 404/84.05–86, 404/90–95, 129; 299/39.1–41.1
See application file for complete search history.

(56) References Cited

U.S. PATENT DOCUMENTS

| | | | | |
|---|---|---|---|---|
| 1,898,158 | A | | 2/1933 | Winkle |
| 2,039,078 | A | | 4/1936 | Hertwig |
| 1,887,341 | A | | 11/1936 | Venable |
| 2,098,895 | A | | 11/1937 | Velten |
| 2,124,438 | A | | 7/1938 | Struk |
| 2,633,782 | A | | 4/1953 | Clement |
| 2,893,299 | A | | 7/1959 | Moir |
| 2,908,206 | A | | 10/1959 | Melanson |
| 2,938,438 | A | | 5/1960 | Hamilton |
| 3,075,436 | A | | 1/1963 | McRae |
| 3,254,392 | A | | 6/1966 | Novkov |
| 3,361,042 | A | | 1/1968 | Cutler |
| 3,694,033 | A | * | 9/1972 | Rowley et al. ..... 299/39.4 |
| 3,732,023 | A | | 5/1973 | Rank |
| 3,746,396 | A | | 7/1973 | Radd |
| 3,807,886 | A | * | 4/1974 | Cutler ..... 404/77 |
| 3,817,644 | A | | 6/1974 | Matson |
| 3,830,321 | A | | 8/1974 | McKenry |
| 3,970,404 | A | | 7/1976 | Benedetti |
| 3,989,401 | A | | 11/1976 | Moench |
| 4,018,540 | A | | 4/1977 | Jackson |
| 4,041,623 | A | * | 8/1977 | Miller et al. ..... 37/382 |
| 4,098,362 | A | | 7/1978 | Bonnice |
| 4,104,736 | A | | 8/1978 | Mendenhall |
| 4,109,737 | A | | 8/1978 | Bovenkerk |
| 4,124,325 | A | | 11/1978 | Cutler |
| 4,127,351 | A | | 11/1978 | Vural |
| 4,139,318 | A | | 2/1979 | Jakob |
| 4,156,329 | A | | 5/1979 | Daniels |
| 4,172,613 | A | | 10/1979 | Furando |
| 4,172,679 | A | | 10/1979 | Wirtgen |
| 4,175,886 | A | | 11/1979 | Moench |

(Continued)

*Primary Examiner* — Raymond W Addie
(74) *Attorney, Agent, or Firm* — Philip W. Townsend, III

(57) ABSTRACT

In one aspect of the present invention a system is disclosed for removing loose aggregate from a paved surface. The system comprises a motorized vehicle that has a degradation drum connected to the underside of the vehicle. The degradation drum is enclosed by a milling chamber. The milling chamber is comprised of a plurality of plates, including a moldboard that is positioned rearward of the degradation drum. The moldboard has an end that is disposed opposite the underside. The end has a plurality of liquid jet nozzles and a blower mechanism that are directed into the milling chamber.

19 Claims, 9 Drawing Sheets

Related U.S. Application Data application No. 11/566,151, filed on Dec. 1, 2006, now Pat. No. 7,458,645, and a continuation-in-part of application No. 11/668,390, filed on Jan. 29, 2007, now Pat. No. 7,507,053, and a continuation-in-part of application No. 11/844,466, filed on Aug. 24, 2007, now Pat. No. 7,942,605.

(56) References Cited

U.S. PATENT DOCUMENTS

| | | | | |
|---|---|---|---|---|
| 4,195,946 | A | 4/1980 | Swisher | |
| 4,199,035 | A | 4/1980 | Thompson | |
| 4,201,421 | A | 5/1980 | Den Besten | |
| 4,215,940 | A | 8/1980 | Lubbers et al. | |
| 4,261,669 | A | 4/1981 | Edo | |
| 4,268,089 | A | 5/1981 | Spence | |
| 4,313,690 | A | 2/1982 | Hojbjerg | |
| 4,335,975 | A | 6/1982 | Schoelkopf | |
| 4,347,016 | A | 8/1982 | Sindelar et al. | |
| 4,407,605 | A | 10/1983 | Wirtgen | |
| 4,439,250 | A | 3/1984 | Acharya | |
| 4,473,320 | A | 9/1984 | Register | |
| 4,484,783 | A | 11/1984 | Emmerich | |
| 4,534,674 | A | 8/1985 | Cutler | |
| 4,590,339 | A | 5/1986 | Scott-Jackson et al. | |
| 4,594,022 | A | 6/1986 | Jeppson | |
| 4,668,017 | A | 5/1987 | Peterson | |
| 4,676,689 | A | 6/1987 | Yant | |
| 4,684,176 | A | 8/1987 | Den Besten | |
| 4,692,350 | A | 9/1987 | Clarke | |
| 4,725,098 | A | 2/1988 | Beach | |
| 4,728,153 | A | 3/1988 | Ojanen | |
| 4,776,862 | A | 10/1988 | Wiand | |
| 4,784,518 | A | 11/1988 | Cutler | |
| 4,793,730 | A | 12/1988 | Butch | |
| 4,827,559 | A | 5/1989 | Norland | |
| 4,836,614 | A | 6/1989 | Ojanen | |
| 4,850,649 | A | 7/1989 | Beach | |
| 4,880,154 | A | 11/1989 | Tank | |
| 4,921,310 | A | 5/1990 | Hedlund | |
| 4,932,723 | A | 6/1990 | Mills | |
| 4,940,288 | A | 7/1990 | Stiffler | |
| 4,944,559 | A | 7/1990 | Sionnet | |
| 4,951,762 | A | 8/1990 | Lundell | |
| 4,968,101 | A | 11/1990 | Bossow | |
| 5,007,685 | A | 4/1991 | Beach | |
| 5,026,205 | A | 6/1991 | Gorski | |
| 5,074,063 | A | 12/1991 | Vannette | |
| 5,079,540 | A | 1/1992 | Narlow et al. | |
| 5,112,165 | A | 5/1992 | Hedlund | |
| 5,131,788 | A | 7/1992 | Hulicsko | |
| 5,141,289 | A | 8/1992 | Stiffler | |
| 5,186,892 | A | 2/1993 | Pope | |
| 5,219,380 | A | 6/1993 | Young | |
| 5,251,964 | A | 10/1993 | Ojanen | |
| 5,303,984 | A | 4/1994 | Ojanen | |
| 5,366,320 | A | 11/1994 | Hanlon | |
| 5,382,084 | A | 1/1995 | Diver | |
| 5,385,426 | A * | 1/1995 | Omann | 404/75 |
| 5,392,540 | A | 2/1995 | Cooper | |
| 5,415,462 | A | 5/1995 | Massa | |
| RE35,088 | E | 11/1995 | Gilbert | |
| 5,503,463 | A | 4/1996 | Ojanen | |
| 5,505,598 | A | 4/1996 | Murray | |
| 5,556,225 | A | 9/1996 | Marino | |
| 5,720,528 | A | 2/1998 | Ritchey | |
| 5,725,283 | A | 3/1998 | O'Neill | |
| 5,730,502 | A | 3/1998 | Montgomery | |
| 5,738,698 | A | 4/1998 | Kapoor | |
| 5,752,782 | A * | 5/1998 | Hulicsko | 404/103 |
| 5,765,926 | A | 6/1998 | Knapp | |
| 5,791,814 | A | 8/1998 | Wiley | |
| 5,794,854 | A | 8/1998 | Yie | |
| 5,823,632 | A | 10/1998 | Burkett | |
| 5,837,071 | A | 11/1998 | Andersson | |
| 5,884,979 | A | 3/1999 | Latham | |
| 5,934,542 | A | 8/1999 | Nakamura | |
| 5,935,718 | A | 8/1999 | Demo | |
| 5,944,129 | A | 8/1999 | Jensen | |
| 5,947,636 | A | 9/1999 | Mara | |
| 5,947,638 | A | 9/1999 | Heims | |
| 5,951,561 | A | 9/1999 | Pepper | |
| 6,051,079 | A | 4/2000 | Andersson | |
| 6,065,552 | A | 5/2000 | Scott | |
| 6,099,080 | A * | 8/2000 | Hirashita et al. | 299/39.3 |
| 6,113,195 | A | 9/2000 | Mercier | |
| 6,122,601 | A | 9/2000 | Swanson | |
| 6,158,920 | A | 12/2000 | Malot | |
| 6,193,770 | B1 | 2/2001 | Sung | |
| 6,196,636 | B1 | 3/2001 | Mills | |
| 6,199,956 | B1 | 3/2001 | Kammerer | |
| 6,287,048 | B1 | 9/2001 | Hollon | |
| 6,341,823 | B1 | 1/2002 | Sollami | |
| 6,357,832 | B1 | 3/2002 | Sollami | |
| 6,371,689 | B1 | 4/2002 | Wiley | |
| 6,457,267 | B1 | 10/2002 | Porter | |
| 6,478,383 | B1 | 11/2002 | Ojanen | |
| 6,481,803 | B2 | 11/2002 | Ritchey | |
| 6,508,516 | B1 | 1/2003 | Kammerer | |
| 6,543,963 | B2 | 4/2003 | Bruso | |
| 6,551,018 | B2 | 4/2003 | Baker | |
| 6,577,141 | B2 | 6/2003 | Gandrud | |
| 6,623,207 | B2 | 9/2003 | Grubba | |
| 6,644,755 | B1 | 11/2003 | Kammerer | |
| 6,692,083 | B2 | 2/2004 | Latham | |
| 6,702,393 | B2 | 3/2004 | Mercier | |
| 6,733,086 | B1 | 5/2004 | McSharry | |
| 6,769,836 | B2 | 8/2004 | Lloyd | |
| 6,779,948 | B2 | 8/2004 | Bruso | |
| 6,786,557 | B2 | 9/2004 | Montgomery, Jr. | |
| 6,799,922 | B2 | 10/2004 | Smith | |
| 6,824,225 | B2 | 11/2004 | Stiffler | |
| 6,846,354 | B2 | 1/2005 | Larsen | |
| 6,851,758 | B2 | 2/2005 | Beach | |
| 6,854,201 | B1 | 2/2005 | Hunter | |
| 6,854,810 | B2 | 2/2005 | Montgomery, Jr. | |
| 6,861,137 | B2 | 3/2005 | Griffin | |
| 6,889,890 | B2 | 5/2005 | Yamazaki | |
| 6,962,395 | B2 | 11/2005 | Mouthaan | |
| 7,150,131 | B2 | 12/2006 | Barker | |
| 7,179,018 | B2 | 2/2007 | Hall | |
| 7,223,049 | B2 | 5/2007 | Hall | |
| 7,287,818 | B1 | 10/2007 | Hall | |
| 7,331,636 | B2 * | 2/2008 | Troudt et al. | 299/39.6 |
| 7,387,345 | B2 | 6/2008 | Hall | |
| 7,387,465 | B2 | 6/2008 | Hall | |
| 7,396,085 | B2 | 7/2008 | Hall | |
| 7,413,375 | B2 | 8/2008 | Hall | |
| 7,473,052 | B2 | 1/2009 | Hall | |
| 7,544,011 | B2 | 6/2009 | Hall | |
| 7,549,821 | B2 | 6/2009 | Hall | |
| 7,585,128 | B2 | 9/2009 | Hall | |
| 7,591,607 | B2 | 9/2009 | Hall | |
| 7,591,608 | B2 | 9/2009 | Hall | |
| 7,641,418 | B2 | 1/2010 | Hall | |
| 7,712,996 | B2 | 5/2010 | Hall | |
| 2002/0070602 | A1 | 6/2002 | Sollami | |
| 2002/0074851 | A1 | 6/2002 | Montgomery | |
| 2002/0153175 | A1 | 10/2002 | Ojanen | |
| 2002/0175555 | A1 | 11/2002 | Mercier | |
| 2003/0137185 | A1 | 7/2003 | Sollami | |
| 2003/0141350 | A1 | 7/2003 | Noro | |
| 2003/0141753 | A1 | 7/2003 | Peay | |
| 2003/0230926 | A1 | 12/2003 | Mondy | |
| 2003/0234280 | A1 | 12/2003 | Cadden | |
| 2004/0026983 | A1 | 2/2004 | McAlvain | |
| 2005/0159840 | A1 | 7/2005 | Lin | |
| 2005/0173966 | A1 | 8/2005 | Mouthaan | |
| 2006/0125306 | A1 | 6/2006 | Sollami | |
| 2008/0284235 | A1 | 11/2008 | Hall | |
| 2011/0278907 | A1 * | 11/2011 | Moller et al. | 299/18 |

* cited by examiner

PLURALITY OF LIQUID JET NOZZLES AND A BLOWER MECHANISM THAT ARE DIRECTED INTO A MILLING CHAMBER

CROSS REFERENCE TO RELATED APPLICATIONS

This application is a continuation-in-part of U.S. patent application Ser. No. 12/888,876 filed Sep. 23, 2010 (which issued as U.S. Pat. No. 7,976,238), which is a continuation-in-part of U.S. patent application Ser. No. 12/145,409 filed Jun. 24, 2008 (which issued as U.S. Pat. No. 7,854,566), which was a continuation-in-part of U.S. patent application Ser. Nos. 11/566,151 filed Dec. 1, 2006 (which issued as U.S. Pat. No. 7,458,645); Ser. No. 11/668,390 filed Jan. 29, 2007 (which issued as U.S. Pat. No. 7,507,053); and Ser. No. 11/844,466 filed Aug. 24, 2007 (which issued as U.S. Pat. No. 7,942,605). All of these documents are herein incorporated by reference for all that they disclose.

BACKGROUND OF THE INVENTION

The present invention relates to machines that are used in road construction, such as a milling machine. These machines may remove a layer or layers of old or defective road surfaces.

Typically, milling machines are equipped with a milling drum secured to the machine's underside. The drums are configured to direct milling debris toward a conveyer, which directs the debris to a dump truck to take off site.

A moldboard may be located behind the milling drum during operation and form part of a milling chamber that encloses the drum. The moldboard is configured to push milling debris forward with the machine. However, some debris, usually escapes underneath the bottom end of the moldboard leaving the recently milled surface too dirty to resurface. Failure to clean the milled surface before resurfacing may result in poor bonding between the new layer and the milled surface. Typically, a sweeper will follow the milling machine to remove the debris, but the sweeper is generally inefficient.

U.S. Pat. No. 7,621,018 by Libhart, which is herein incorporated by reference for all that it contains, discloses a machine having a debris-intake hood of the type designed to pickup or remove dust, particulates, and other debris from a road or pavement surface.

U.S. Pat. No. 6,733,086 by McSharry et al., which is herein incorporated by reference for all that it contains, discloses a vacuum system mounted on a portable milling machine for extracting material cut by the milling drum of the machine from the surface of a roadway.

U.S. Pat. No. 5,536,073 by Sulosky et al, which is herein incorporated by reference for all that it contains, discloses a drum assembly and parts of that assembly, for the milling of a roadway substrate to a fine texture. The invention also concerns a method for milling the roadway substrate to a fine texture.

U.S. Pat. No. 4,786,111 by Yargici, which is herein incorporated by reference for all that it contains, discloses an apparatus and method for delivering liquid coolant to drum mounted cutting tools.

BRIEF SUMMARY OF THE INVENTION

In one aspect of the present invention, a system for removing loose aggregate from a paved surface includes a motorized vehicle that has a degradation drum connected to the underside of the vehicle. The degradation drum is enclosed by a milling chamber. The milling chamber is comprised of a plurality of plates, including a moldboard that is positioned rearward of the degradation drum. The moldboard has an end that is disposed opposite the underside. The end has a plurality of liquid jet nozzles and a blower mechanism that are directed into the milling chamber.

The jet nozzles may be located under the moldboard's end. The nozzles may push the aggregate with a liquid stream toward the milling drum and suppress dust generated from milling. The liquid may also be used to reduce friction, absorb heat, and clean the drum. Another series of nozzles located inside the milling chamber may clean the moldboard off and direct any aggregate back to the drum.

The blower mechanism connected to the end of the moldboard may direct a gas, such as air, $CO_2$, exhaust, or ambient air underneath the moldboard. The gas may dry off the roadway from the liquid jets as well as contribute to directing aggregate toward the milling drum. The gas may also force any residual liquid forward onto the picks which may cool and lubricate them as they degrade the surface. Cooling the picks may lead to longer pick life.

DETAILED DESCRIPTION OF THE INVENTION AND THE PREFERRED EMBODIMENT

Figure 1:
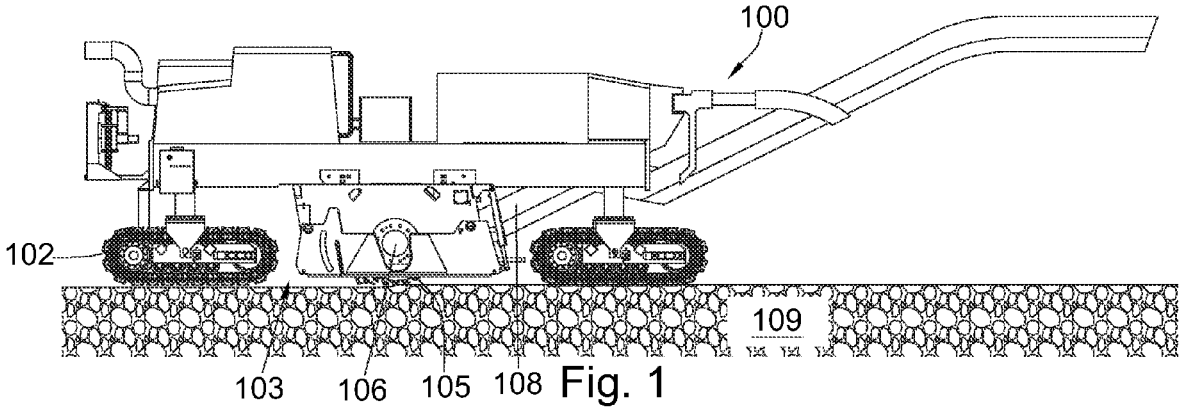
FIG. 1 is an orthogonal diagram of an embodiment of a motorized vehicle.

FIG. 1 discloses a milling machine 100 that may be used to remove asphalt from a paved surface 109. The current embodiment discloses the machine on tracks 102, but in other embodiments tires or other propulsion mechanisms may be used. A milling chamber 103 may be attached to the underside of the vehicle 100 and contain a milling drum 105, axle 106, and an opening for one end of a conveyor belt 108. The conveyor belt 108 may be adapted to remove debris from the milling chamber 109. The conveyor 108 may deposit the degraded surface into a truck (not shown). The truck may remove the degraded surface from the milling area.

Figure 2:
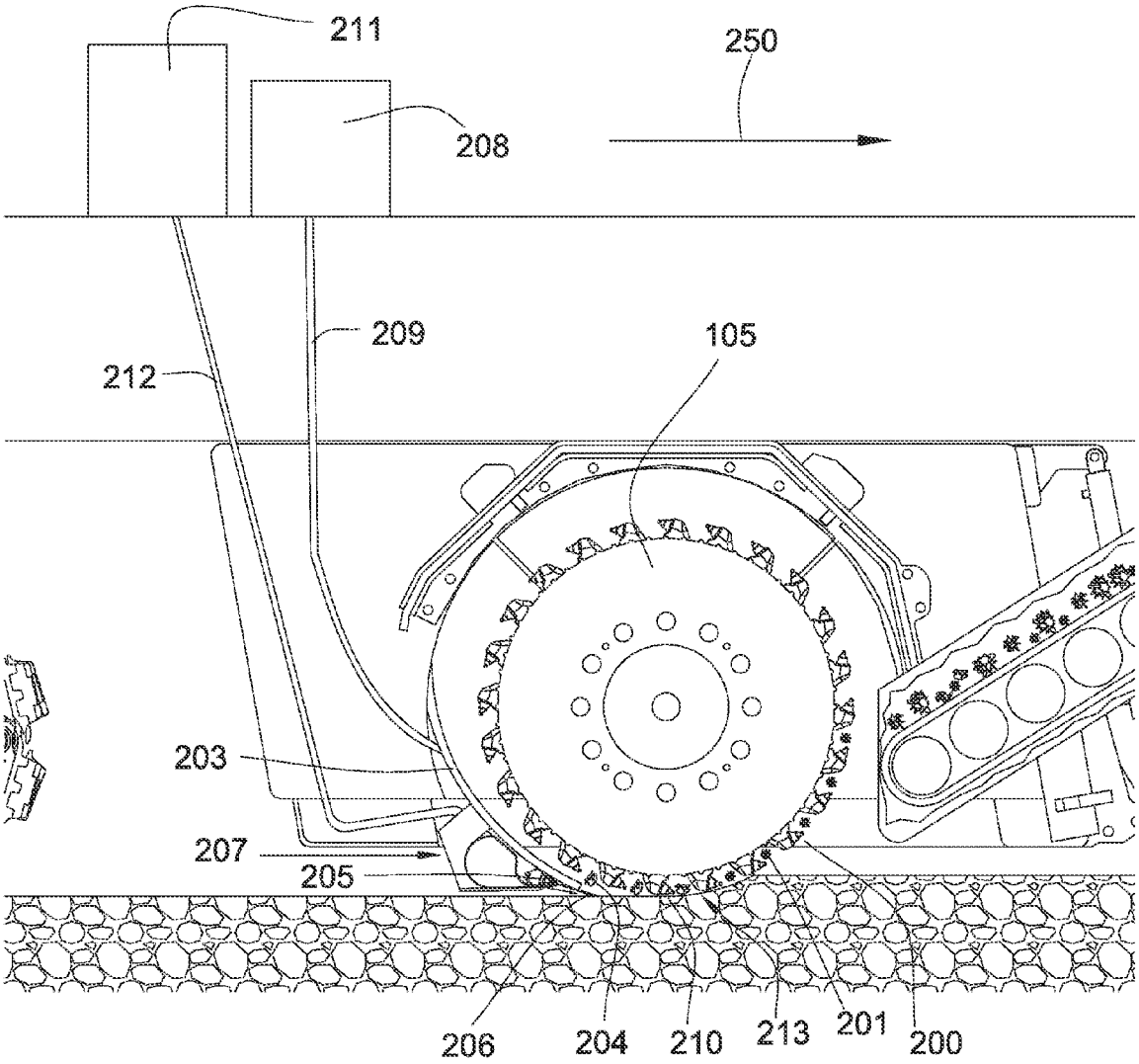
FIG. 2 is a cutaway diagram of an embodiment of a milling chamber.

FIG. 2 discloses the milling chamber 103 and the conveyor belt 108. In this embodiment, the milling machine 100 travels to the right and the drum 105 rotates counter-clockwise. An internal combustion engine (not shown) may be used to drive the milling drum 105. The picks 200 degrade the paved surface 109 by rotating into the paved surface as the milling vehicle 100 travels in the specified direction as indicated by arrow 250. The picks 200 may comprise tungsten carbide or synthetic diamond tips. The picks 200 may lift the broken aggregate up 201, some of which will fall onto the conveyor belt 108. But, some of the aggregate may be carried over the drum 105 by the picks 200 to the opposite side of the milling chamber 103. Some of the aggregate may fall off the drum 105 and land on a curved moldboard 203 or into the cut 210 formed by the drum.

The moldboard 203 may be located rearward of the milling drum 105. In this embodiment the moldboard 203 is curved in toward the milling drum 105. The end of the moldboard 203 may be adapted to push loose aggregate 204 forward. In some cases, the moldboard 203 may push the loose aggregate 204 forward into the milling area 213 where the loose aggregate 201 may be picked up by the milling drum 105 and placed on the conveyor belt 108. Some aggregate may fall onto the moldboard 203 from the milling drum and the picks 200 may lift off and deposit the aggregate onto the conveyor belt 108. Liquid jet nozzles 205 may lie rearward of the moldboard 203 and may force the aggregate 204 forward. This prevents aggregate from escaping the milling chamber 103 under the moldboard 203 as the milling machine 100 moves forward. As the fluid stream 206 from the jet nozzles 205 is ejected into the milling chamber 103, the loose aggregate is forced forward into the milling area 213. In some embodiments, the nozzles 205 fog, mist, spray, and/or shoot liquid 206 underneath an end of the moldboard 203. Some embodiments include the liquid nozzles 205 attached to the backside of the moldboard 203 and/or the moldboard's front side. A blower mechanism 207 may lie rearward of the liquid jet nozzles 205 and may blow onto the cut surface 210 after the nozzles 205 have cleaned the surface 210.

The liquid nozzles 205 may be in communication with a fluid reservoir 208 through a fluid pathway 209. The fluid reservoir 208 may be attached to the vehicle 100. The liquid nozzles 205 may use less energy in embodiments where the moldboard 203 is curved and directs the aggregate 204 to the milling area 213. Spraying less liquid 206 onto the cut surface 210 may conserve resources and be more efficient. When the liquid nozzles 205 spray less liquid 206 on the cut surface 210 the blower mechanism 207 placed rearward the liquid nozzles 205 may use less energy to dry the cut surface 210. The blower mechanism may also move the residual water from the liquid nozzles forward contributing to cleaning the road and debris. The angle between the end of the moldboard 203 and the ground 210 may be similar to the angle between the nozzles' spray 206 and the ground 210. This may lead to the liquid 206 having a synergistic effect with the moldboard 203 in forcing the aggregate 204 forward.

The liquid nozzles 205 may spray liquid 206 into the milling chamber 103 and reduce dust that may interfere with bonding a new surface. In other embodiments, a blower mechanism 207 may assist in blowing loose aggregate 204 forward. This may lead to the cut surfaces being substantially free of debris, asphalt, dirt, millings, aggregate, tar, rubber, etc.

The current diagram discloses the blower mechanism 207 that may be located rearward of the plurality of liquid nozzles 205. The blower mechanism 207 may be in communication with a compressor 211 or air blower through a gas pathway 212. The compressor 211 may draw in atmospheric air from around the vehicle 100, compress it, and force it down to the blower mechanism 207. An air blower could draw in large volumes of air and accelerate the air through the manifold at high velocities with relatively low pressures. In some embodiments, the blower mechanism 207 may then expel a combination of air, engine exhaust, and other gases to the paved surface 210. In another embodiment, the compressor 211 may contain a certain amount of compressed gas at high pressure. The gas may then be released as needed into the gas pathway 212 and supply the blower mechanism 207.

In this embodiment the blower mechanism 207 may force the liquid 206 toward the picks 200. Liquid 206 may strike the picks 200 as they engage the paved surface 210 and cling to the debris, dirt, asphalt, aggregate, tar, rubber, etc. that may remain on the picks 200. The substances that remain on the picks 200 may fall off the picks 200 onto the cut surface 210. Those substances may then return to the milling area 213 and the picks 200 may pick the substances up and direct them to the conveyor belt 108.

Picks may wear from continually striking the paved surface 210 and heating up. The metal and/or diamond picks may become weaker and more brittle due to the increased heat. The blower mechanism 207 may force liquid 206 onto the picks 200 cooling them. The liquid 206 that contacts the picks 200 may also lubricate them, which reduces friction and heat.

In some embodiments, the liquid jets and the blower mechanism may be formed together. This may be accomplished by extruding a manifold for both the air blower and the liquid jets from the same piece of metal.

Figure 3A:
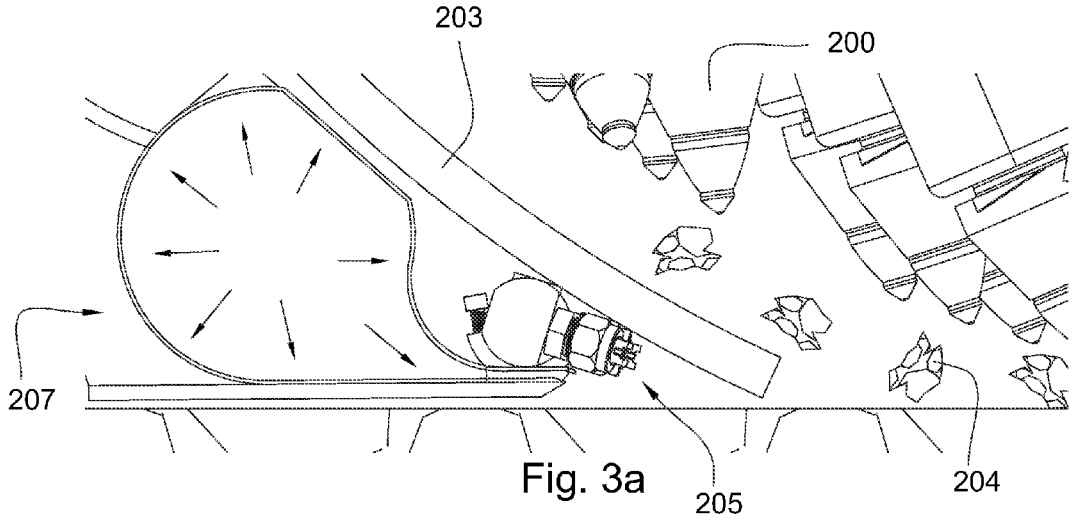
FIG. 3*a* is a cutaway diagram of an embodiment of a plurality of liquid jet nozzles and a blower mechanism.

FIG. 3*a* discloses an embodiment of the invention where the liquid jet nozzles 205 and blower mechanism 207 may be proximate the rear of the moldboard 203. The picks 200 may engage the paved surface 210 and the moldboard 203 and may be fully extended while the liquid nozzles 205 and blower mechanism 207 are not operating.

Figure 3B:
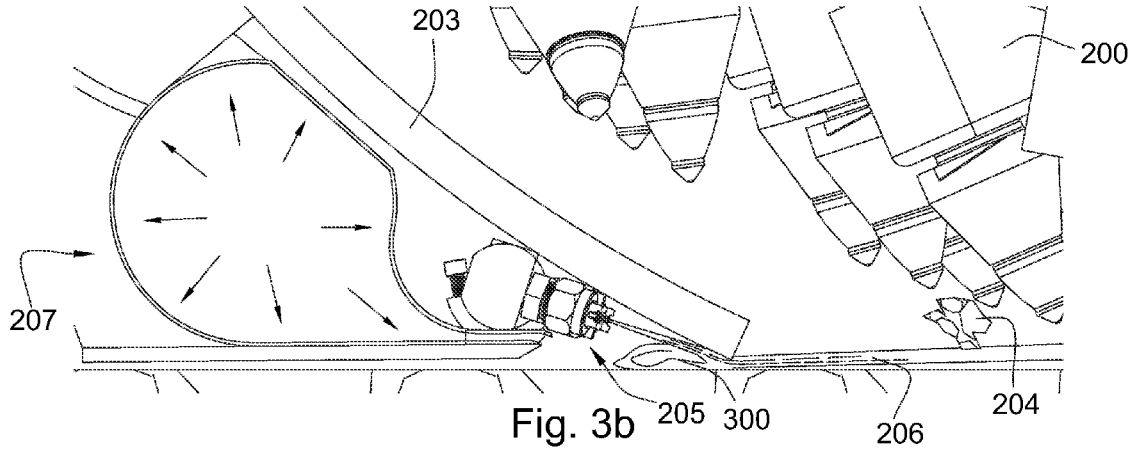
FIG. 3*b* is another cutaway diagram of an embodiment of a plurality of liquid jet nozzles and a blower mechanism.

FIG. 3*b* discloses the milling chamber 103 with the picks 200 engaged, cutting a section of paved surface 210. In this diagram the moldboard 203 is fully extended and the liquid jet nozzles 205 are spraying. The liquid nozzles 205 may engage the loose aggregate 204 that has fallen behind the milling drum 105. The liquid nozzles 205 may force the loose aggregate 204 forward into the milling area 213 where the picks 200 may pick up the aggregate and deposit it on the conveyor belt 108.

Liquid 300 that is left on the paved surface 210 after the milling process may delaying the start of the resurfacing process. When the blower mechanism 207 is not expelling gas the liquid jet stream 206 may contact stagnant liquid 300 left on the paved surface 210. The liquid 206 contacting stagnant liquid 300 before the paved surface 210 may result in the liquid nozzles 205 ineffectively expending more energy.

Figure 3C:
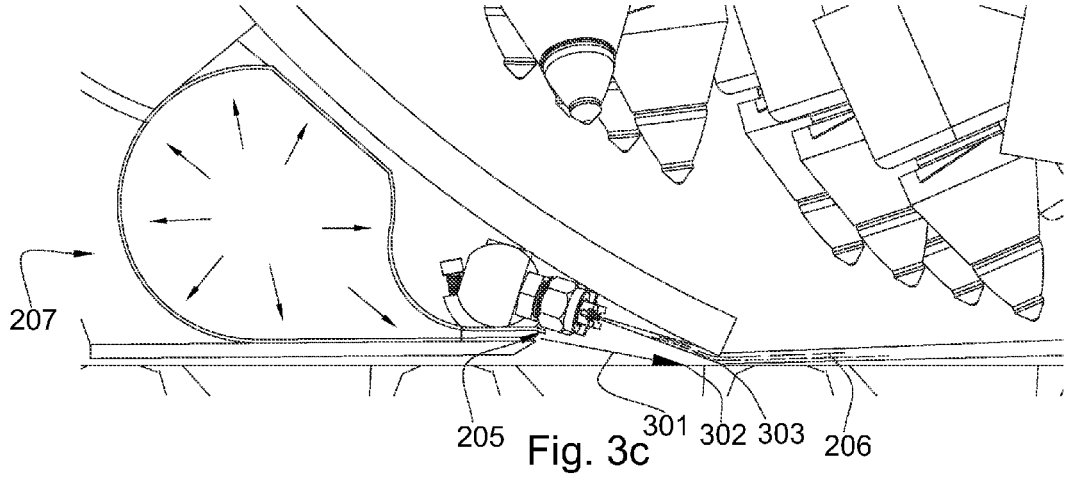
FIG. 3*c* is another cutaway diagram of an embodiment of a plurality of liquid jet nozzles and a blower mechanism.

FIG. 3*c* discloses the current embodiment wherein the liquid nozzles 205 spray liquid 206 into the milling chamber 103 and the blower mechanism 207 forces excess liquid 206 forward. The liquid nozzles 205 may be angled less than 45° to spray liquid 206 into the milling chamber 103. They may also be situated to spray the liquid 206 under the bottom edge of the moldboard 203, effectively forcing the loose aggregate 204 forward into the milling area 213.

The blower mechanism 207 may expel gas 301 that contacts the paved surface 302 rearward of where the liquid contacts the paved surface 303. This gas 301 may contact the ground 302 and rebound into the liquid 206 forcing the liquid 206 forward into the milling chamber 103. This may contribute to a dry cut in the paved surface immediately after the milling vehicle 100 passes through. The use of the blower mechanism 207 may save energy and liquid since the liquid 206 may contact the ground 303 directly and enter into the milling chamber at high velocity.

Figure 4A:
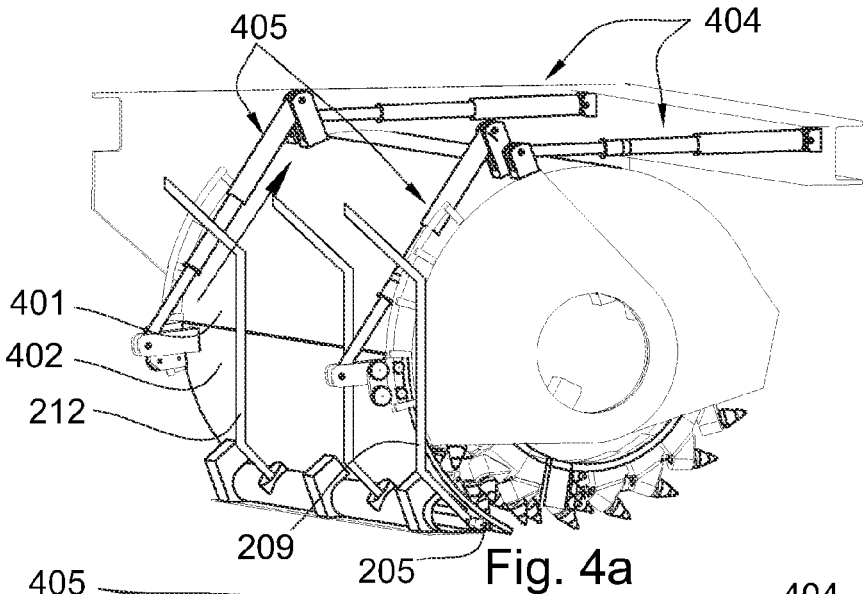
FIG. 4*a* is a perspective diagram of an embodiment of a milling chamber.

FIG. 4*a* is a diagram of an embodiment of the moldboard 204 that may comprise two parts adapted to rotate about the contour of the milling drum 105. The moldboard 204 disclosed here follows the contour of the milling drum 105. Hydraulic arms 404, 405 may retract both an upper portion 401 and a lower extension 402 of the moldboard. In this embodiment the blower mechanism 207 and liquid nozzles 205 may retract with the lower extension 402. The blower mechanism 207 and liquid nozzles 205 may be attached rigidly to the lower extension 402. Also, rigidly attaching the blower mechanism 207 and liquid nozzles 205 to the lower extension may reduce excessive wear from constantly removing and replacing the nozzles. The gas pathway 212 may be flexibly attached to the compressor 211 and the blower mechanism 207. The fluid pathway 209 may also flexibly connect to the fluid reservoir 208 and the plurality of liquid jet nozzles 205.

Figure 4B:
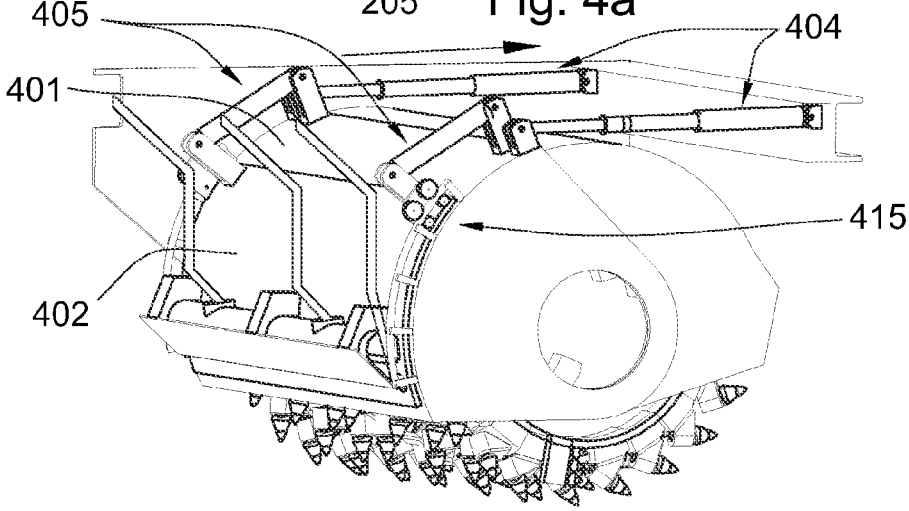
FIG. 4*b* is a perspective diagram of another embodiment of a milling chamber.

FIG. 4*b* discloses the moldboard with the upper portion 401 in a rotated position with the lower extension 402 down. Hydraulic arms may be situated in two pairs 404, 405 with each pair having two arms. The first set of hydraulic arms 405 may rotate the extension 402 around a set of pins 415 that retract to reveal a portion of the picks. The upper portion 401 and the lower extension 402 may follow the contour of the milling drum as they are retracted. In another embodiment, the two parts may rotate around the milling drum on rails.

Figure 4C:
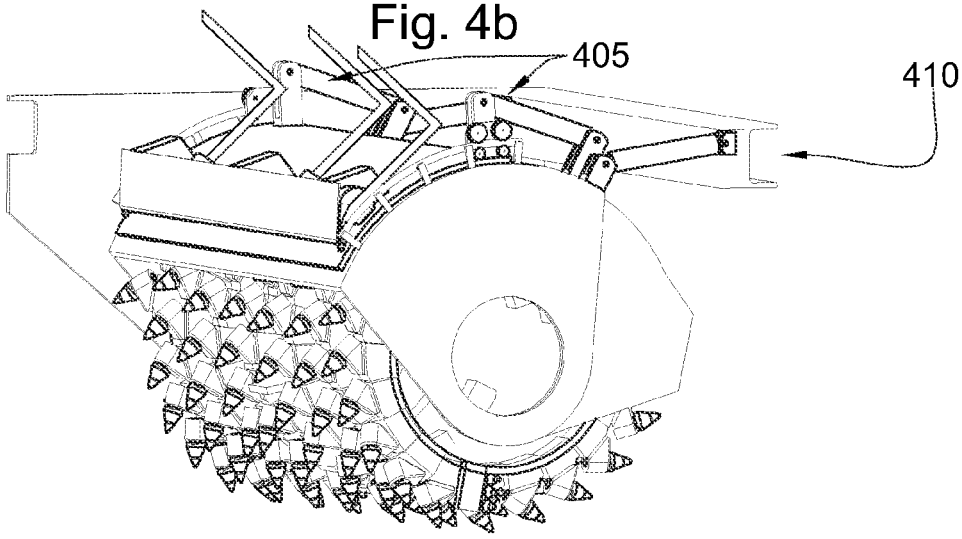
FIG. 4*c* is a perspective diagram of another embodiment of a milling chamber.

FIG. 4*c* discloses the upper portion 401 in a rotated position with the lower extension 402 rotated to reveal the picks. This may be achieved through the second set of hydraulic arms 405. These arms 405 may connect the upper portion 401 and the vehicle frame 410. These arms 404 may retract, thereby pulling the lower extension 402 towards the upper portion 401. In some embodiments, the hydraulic arms 404 may protect the rotated moldboard and all that is attached, lifting them out of the way of the paved surface while the vehicle is travelling, but not degrading the surface. Also, rotating the moldboard around the milling drum may facilitate the cleaning of the picks as many of the picks may then be accessible.

Figure 5:
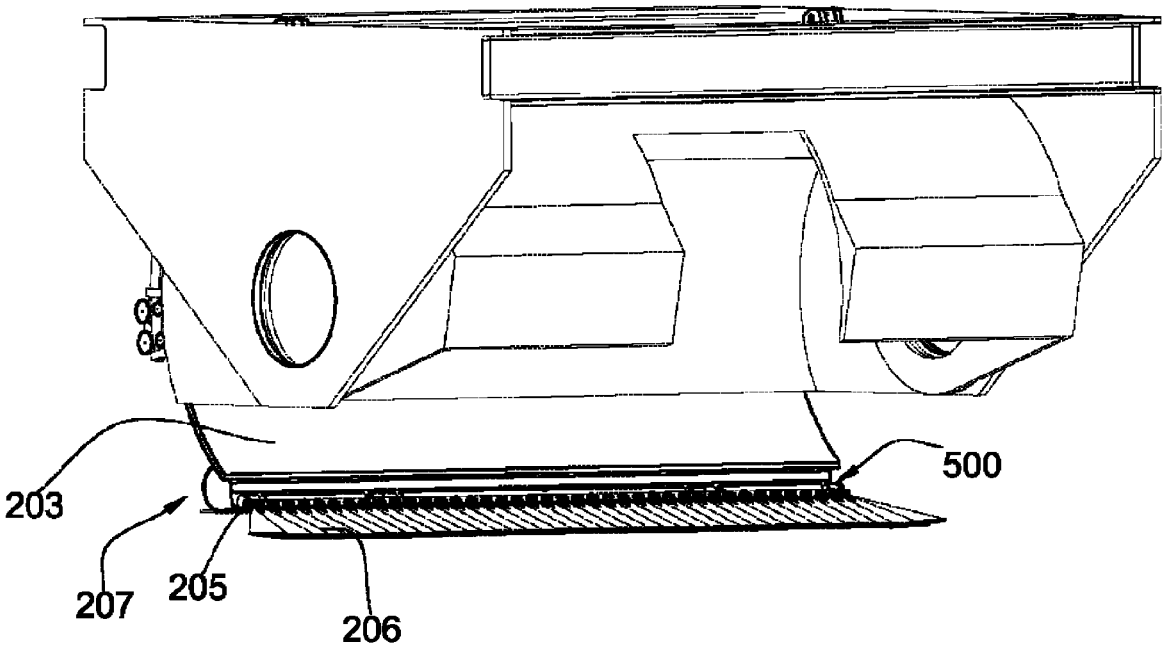
FIG. 5 is a perspective diagram of another embodiment of milling chamber.

FIG. 5 is a diagram of a perspective view of the milling chamber 103, including the moldboard, the plurality of liquid nozzles 205, and the blower mechanism 207. In this diagram the milling drum has been removed and the moldboard 203 has been drawn up slightly to disclose the liquid jet nozzles 205. The nozzles 205 may expel a liquid, steam, water, polymers, synthetic clay, surfactants, binding agents, or combinations thereof and may be attached to a fluid manifold 500. The purpose of the fluid manifold 500 may be to evenly disperse the liquid 206 from the fluid pathway into the liquid nozzles 205. The fluid manifold 500 may attach to the fluid pathway 209 and the fluid pathway 209 to the fluid reservoir 208. The liquid 206 may travel from the fluid reservoir 208, through the fluid pathway 209, and into the fluid manifold 500 where the liquid 206 may be distributed to one or more of the jet nozzles 205.

The liquid nozzles 205 may extend the length of the moldboard 203 and spray underneath the entirety of the moldboard 203. The nozzles 205 may eject the liquid 206 in a direct path from the end of the nozzles toward the milling area 213 and may force the liquid 206 under the base of the moldboard 203 and contain the loose aggregate ahead of the moldboard 203. Liquid and energy may be minimized as the liquid 206 pushes the aggregate in the shortest path from the end of the moldboard 203 to the milling area 213. In some embodiments, the liquid nozzles 205 may dispense liquid 206 in a crosswise pattern and may more effectively clear the cut surface of debris.

Figure 6:
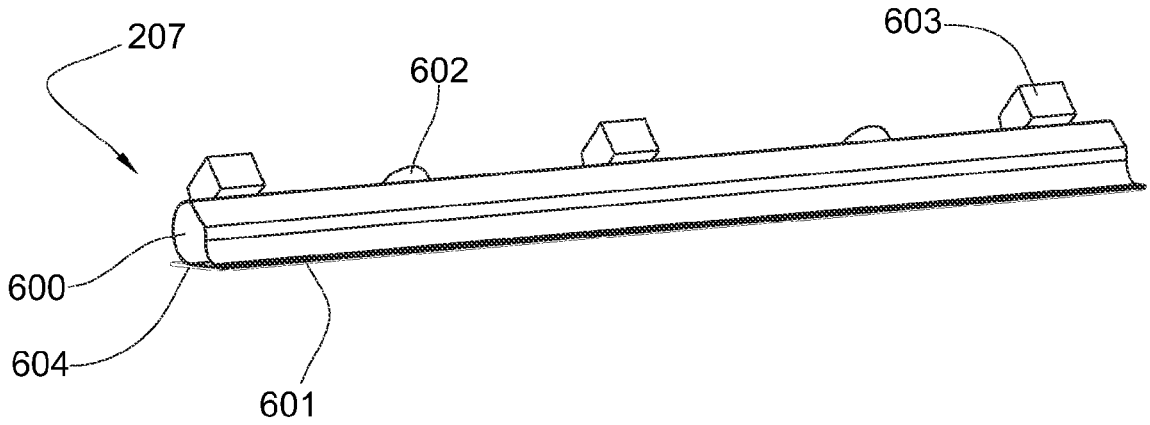
FIG. 6 is a perspective diagram of an embodiment of a blower mechanism.

FIG. 6 is a diagram of a perspective view of the blower mechanism. The blower mechanism 207 may comprise a gas manifold 600 and a release slit 601 that spans a length of the blower mechanism. The gas manifold 600 may be attached to the gas pathway 212 through the conduits 602 that may be manufactured into the rear of the gas manifold 600. The gas manifold 600 and gas pathway 212 may also be adapted to withstand hot gases.

The underside of the blower mechanism 207 may be adapted to come into contact with the cut surface through the use of a guard 604. The guard 604 may comprise a material that has a hardness of at least 40 HRc, such as a cemented metal carbide, silicon carbide, cubic boron nitride, polycrystalline diamond, harden steel, or combinations thereof. The guard 603 may be firmly attached to the moldboard 203 and support the gas manifold 600, liquid jet nozzles 205, and the fluid manifold 500. The guard 603 may also prevent the manifolds 500, 600 and the liquid nozzles 205 from excessive wear that may form holes in the manifolds. Holes may ruin the gas manifold 600 reducing its efficiency.

Figure 7:
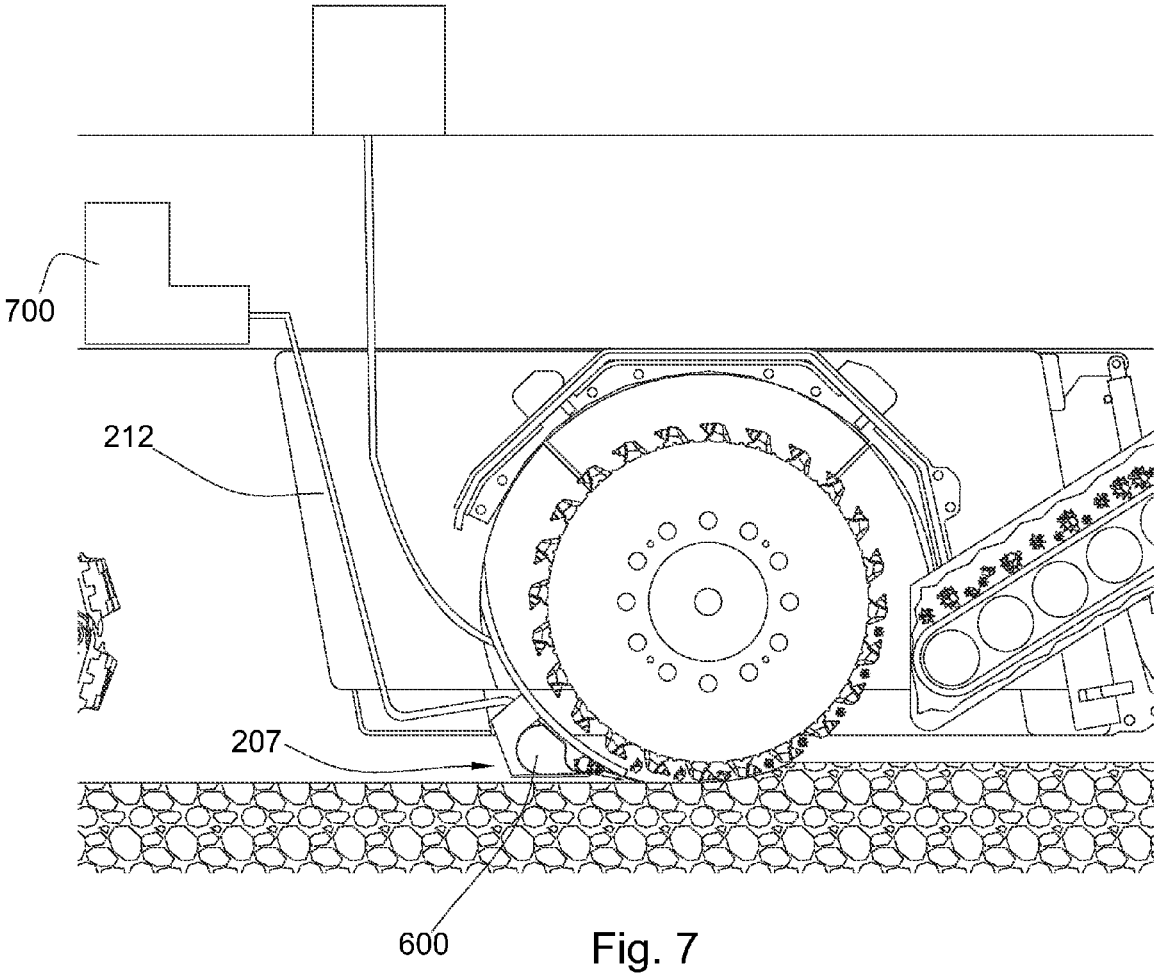
FIG. 7 is a cutaway diagram of a gas pathway and blower mechanism.

FIG. 7 is a diagram that discloses the gas pathway 212 connected to the milling vehicle's engine 700 and the blower mechanism 207. The gas pathway 212 may deliver exhaust from the vehicle's engine 700 to the gas manifold 600. The gas pathway 212 may also be configured to exchange temperatures other heated gases in the milling machine. The blower mechanism 207 may draw from the engine's exhaust. In some embodiments, the gas pathway 212 may attach to an exhaust pipe on the vehicle 100 and draw the exhaust from the exhaust pipe and deliver the exhaust to the gas manifold 600. In some embodiments, the gas pathways 212 connected to the engine 700 and the compressor 211 may merge. In these embodiments, the gas pathway 212 may deliver the merged exhaust and the compressed gas to the blower mechanism 207. The exhaust may mix with the compress gas and raising its temperature.

Figure 8:
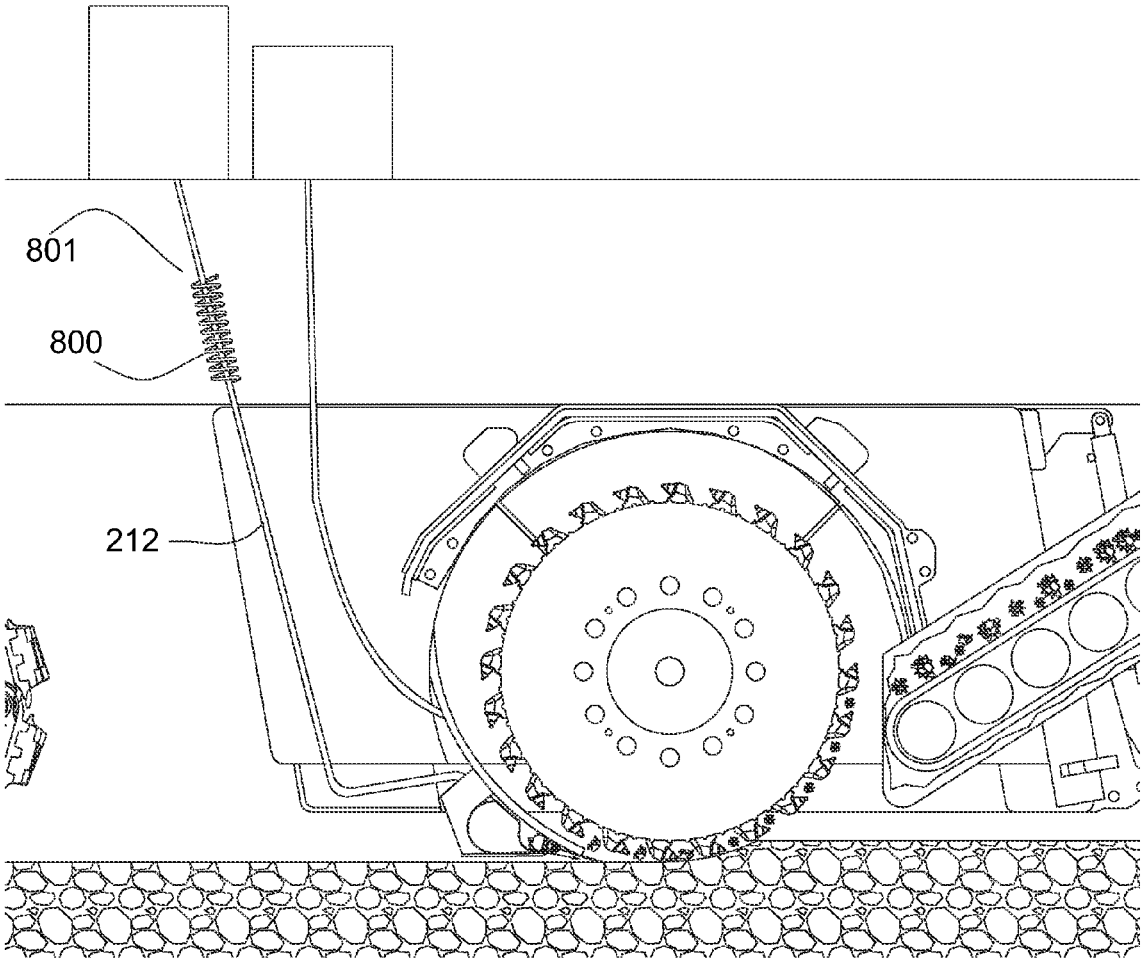
FIG. 8 is a cutaway diagram of an embodiment of a heating element.

FIG. 8 discloses a heating element 800 in thermal communication with the gas pathway 212. The heating element 800 may be wrapped around the gas pathway 212 as disclosed, located inside the pathway, or combinations thereof. The heating element 800 may substantially heat the gas as it passes through the gas pathway 212 on the way to the gas manifold 600. In some embodiments, the heating element may heat the gas through a combination of exhaust joining the gas in the gas pathway 212 and a heating element 800 heating the gas as it travels through the gas pathway 212. In some embodiments, a heating element may be disposed within the gas pathway 212, which may be used to heat the gas as it passes through the pathway 212. Other embodiments may contain a heating element that may draw in gas, heat it up, and then dispense it back into the gas pathway.

The heating element may be an electric resistor coil, a gas burner, torch, fluid heat exchanger, or combinations thereof.

Figure 9:
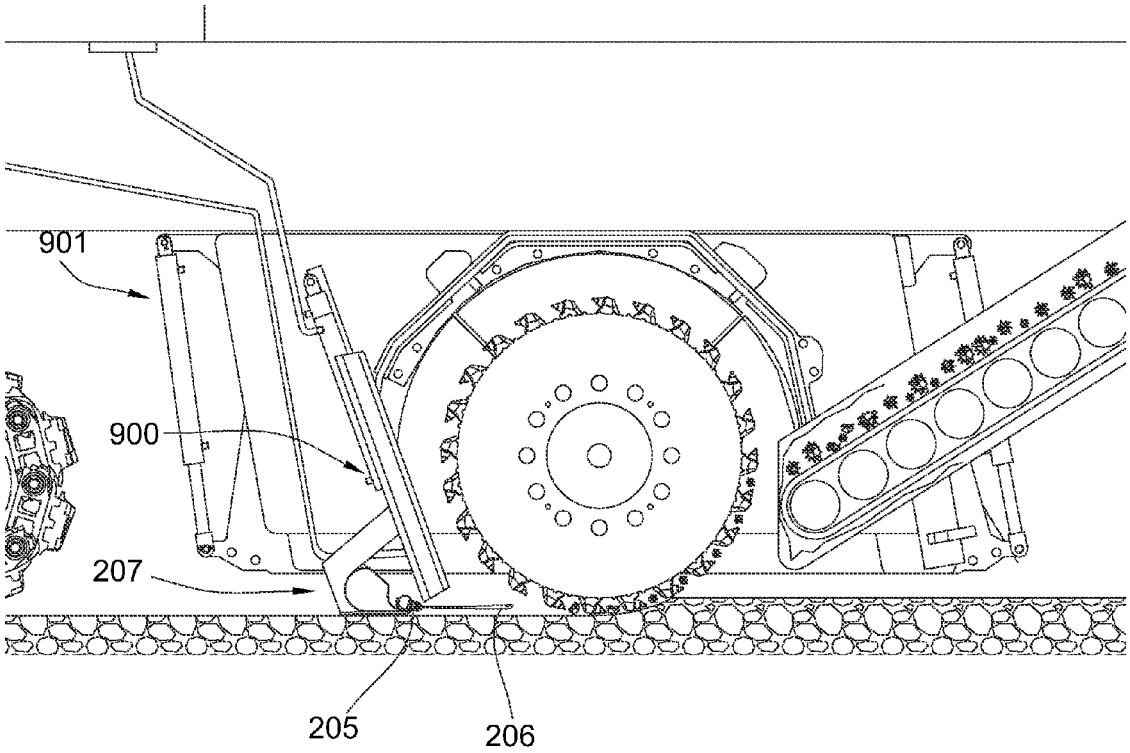
FIG. 9 is a cutaway diagram of an embodiment of a milling chamber.

FIG. 9 is a diagram of an alternative embodiment where the liquid jet nozzles 205 and the blower mechanism 207 are proximate the rear of a straight, angled moldboard 900. The liquid nozzles 205 and/or blower mechanism 207 may be angled down and travel under the moldboard 205 and the liquid 206 and/or air 301 ejecting may enter the milling chamber 103. The liquid jet nozzles 205 and blower mechanism 207 may expel liquid 206 and gas 301 continuously or intermittently to contain the aggregate in front of the moldboard 900. The moldboard 900 may have hydraulic arms 901 that may translate the moldboard 900 vertically. Another embodiment may contain a moldboard 900 that approaches the milling drum 105 from a plurality of angles.

What is claimed is:

1. A system for removing aggregate from a paved surface, comprising:

a vehicle comprising a degradation drum connected to an underside of the vehicle;

the degradation drum is enclosed by a milling chamber;

the milling chamber being defined by a plurality of plates including a moldboard positioned rearward of the degradation drum;

the moldboard comprising an end disposed opposite the underside; and the end comprising a plurality of liquid jet nozzles and a blower mechanism that are directed into the milling chamber;

wherein the plurality of liquid jet nozzles and blower mechanism are positioned to push aggregate in a direction of travel.

2. The system of claim 1, wherein the blower mechanism is located rearward of the plurality of liquid jet nozzles.

3. The system of claim 1, wherein the blower mechanism expels gas that contacts the paved surface rearward of where liquid from the nozzles is configured to contact the paved surface.

4. The system of claim 1, wherein the plurality of liquid jet nozzles are configured to eject liquid into the milling chamber.

5. The system of claim 1, wherein the nozzles is configured to force liquid under the end of the moldboard.

6. The system of claim 1, wherein the plurality of liquid jet nozzles is in communication with a fluid reservoir through a fluid pathway.

7. The system of claim 1, wherein the blower mechanism is in communication with a compressor or air blower through a gas pathway.

8. The system of claim 1, wherein the plurality of liquid jet nozzles is rigidly fixed to at least a portion of the moldboard.

9. The system of claim 1, wherein the fluid pathway is flexibly coupled to at least a portion of the moldboard.

10. The system of claim 1, wherein the blower mechanism is rigidly fixed to at least a portion of the moldboard.

11. The system of claim 1, wherein the gas pathway is flexibly coupled to at least a portion of the moldboard.

12. The system of claim 1, wherein the blower mechanism comprises an underside configured to contact the paved surface.

13. The system of claim 1, wherein a heater is configured to heat the liquid passing through the fluid pathway.

14. The system of claim 1, wherein the gas pathway is configured to receive exhaust from an engine of the milling machine.

15. The system of claim 1, wherein the moldboard is curved into the milling chamber.

16. The system of claim 1, wherein moldboard is substantially flat and slightly angled into the milling chamber.

17. The system of claim 1, wherein the plurality of liquid jets span at least a majority of a width of the moldboard.

18. The system of claim 1, wherein the blower mechanism spans at least a majority of a width of the moldboard.

19. The system of claim 1, wherein the blower mechanism and the liquid jets may be formed in a unithary piece.

* * * * *